US007264337B2

(12) United States Patent
Lee et al.

(10) Patent No.: US 7,264,337 B2
(45) Date of Patent: Sep. 4, 2007

(54) INK EJECTING METHOD AND INK-JET PRINTHEAD UTILIZING THE METHOD

(75) Inventors: You-seop Lee, Yongin-si (KR); Suk-han Lee, Yongin-si (KR); Yong-soo Oh, Seongnam-si (KR); Seung-joo Shin, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 327 days.

(21) Appl. No.: 10/757,391

(22) Filed: Jan. 15, 2004

(65) Prior Publication Data

US 2004/0145632 A1 Jul. 29, 2004

(30) Foreign Application Priority Data

Jan. 15, 2003 (KR) ..... 10-2003-0002729

(51) Int. Cl.
*B41J 2/06* (2006.01)

(52) U.S. Cl. ..... 347/55

(58) Field of Classification Search ..... 347/55, 347/74–77

See application file for complete search history.

(56) References Cited

U.S. PATENT DOCUMENTS 4,263,601 A 4/1981 Nishimura et al.
4,479,135 A 10/1984 Kohashi
4,752,783 A 6/1988 Saito et al. ..... 346/1.1
4,882,595 A 11/1989 Trueba et al. ..... 346/140
5,144,340 A * 9/1992 Hotomi et al. ..... 347/55
6,336,697 B1 * 1/2002 Fukushima ..... 347/20
6,435,665 B2 * 8/2002 Lerat et al. ..... 347/54

FOREIGN PATENT DOCUMENTS

EP 0 911 164 A2 4/1999
EP 0 911 164 A3 4/1999

* cited by examiner

*Primary Examiner*—Stephen Meier
*Assistant Examiner*—Geoffrey S. Mruk
(74) *Attorney, Agent, or Firm*—Lee & Morse, P.C.

(57) ABSTRACT

A method of ejecting ink from a ink-jet printhead includes filling a rear end of a nozzle with ink using a capillary force, the rear end of the nozzle being surrounded by a hydrophilic layer, forming an electric field directed toward an outlet of the nozzle on a front end of the nozzle, the front end of the nozzle being surrounded by a hydrophobic layer, varying a surface tension of ink to separate ink droplets having a predetermined volume from ink and to move the separated ink droplets within the front end of the nozzle toward the outlet of the nozzle, and ejecting the separated ink droplets through the outlet of the nozzle.

20 Claims, 9 Drawing Sheets

INK EJECTING METHOD AND INK-JET PRINTHEAD UTILIZING THE METHOD

BACKGROUND OF THE INVENTION

1. Field of the Invention

The present invention relates to an ink-jet printhead. More particularly, the present invention relates to an ink ejecting method and an ink-jet printhead utilizing the method.

2. Description of the Related Art

Typically, ink-jet printheads are devices for printing a predetermined image, color or black, by ejecting a small volume droplet of printing ink at a desired position on a recording sheet. Ink-jet printheads are largely categorized into two types depending on which ink droplet ejection mechanism is used. A first type is a thermally driven ink-jet printhead in which a heat source is employed to form and expand bubbles in ink causing ink droplets to be ejected. A second type is a piezoelectrically driven ink-jet printhead in which a piezolectric crystal bends to exert pressure on ink causing ink droplets to be ejected.

FIGS. 1A and 1B illustrate examples of a conventional thermally driven ink-jet printhead. FIG. 1A illustrates a cutaway perspective view of a structure of a conventional ink-jet printhead. FIG. 1B illustrates a cross-sectional view for explaining an ink droplet ejection mechanism of the conventional ink-jet printhead shown in FIG. 1A.

The conventional thermally driven ink-jet printhead shown in FIGS. 1A and 1B includes a manifold 22 provided on a substrate 10, an ink channel 24 and an ink chamber 26 defined by a barrier wall 14 installed on the substrate 10, a heater 12 installed in the ink chamber 26, and a nozzle 16 that is provided on a nozzle plate 18 and through which ink droplets 29' are ejected. When a pulse-shaped current is supplied to the heater 12 and heat is generated in the heater 12, ink 29 filled in the ink chamber 26 is heated, and a bubble 28 is generated. The formed bubble 28 continuously expands and exerts pressure on the ink 29 contained within the ink chamber 26. This pressure causes the ink droplets 29' to be expelled through the nozzle 16. Subsequently, ink 29 is absorbed from the manifold 22 into the ink chamber 26 through the ink channel 24, thereby refilling the ink chamber 26 with ink 29.

However, in the thermally driven ink-jet printhead, when ink droplets are ejected due to the expansion of bubbles, a portion of the ink in the ink chamber 26 flows backward to the manifold 22, and an ink refill operation is performed after ink is ejected. Thus, there is a limitation in implementing high printing speed.

Additionally, a variety of ink droplet ejection mechanisms as well as the two above-described ink droplet ejection mechanisms may be used in the ink-jet printhead and include an ink droplet ejection mechanism using an electrostatic force.

FIGS. 2A and 2B illustrate another example of a conventional ink droplet ejection mechanism and schematically show a principle of ink droplet ejection using an electrostatic force. FIG. 3 illustrates a schematic cross-sectional view of a conventional ink-jet printhead adopting the ink ejecting method shown in FIGS. 2A and 2B.

Referring to FIG. 2A, an opposite electrode 33 is disposed to be opposite to a base electrode 32, and ink 31 is supplied between the two electrodes 32 and 33. A DC power source 34 is connected to the two electrodes 32 and 33. When a voltage is applied from the power source 34 between the two electrodes 32 and 33, an electrostatic field is formed between the two electrodes 32 and 33. The electrostatic field causes a Coulomb force toward the opposite electrode 33 that acts on ink 31. At the same time, resistance against the Coulomb force acts on ink 31 due to the surface tension and viscosity of ink 31. Accordingly, ink 31 is not easily ejected to the opposite electrode 33. Thus, a very high voltage should be applied between the two electrodes 32 and 33 so that ink droplets are separated from the surface of ink 31 to be ejected. In this case, ejection of ink droplets occurs irregularly and a predetermined portion of ink 31 is heated locally. More specifically, temperature $T_1$ of ink 31' in a region S1 increases to be higher than temperature $T_0$ of ink 31 in another region. Then, ink 31' in the region S1 expands, and an electrostatic field is condensed on the region S1, and an electric charge is collected in the electrostatic field. As such, a repulsive force, acting between electric charges, and the Coulomb force, caused by the electrostatic field, act on ink 31' in the region S1. Thus, as shown in FIG. 2B, ink droplets are separated from ink 31' in the region S1 and move toward the opposite electrode 33.

Referring to FIG. 3, a pair of wall members 40 and 41 are spaced apart from each other, and ink 43 is filled therebetween. An exhaust hole 44 opposite to a recording paper 42 is provided on one side end of the wall members 40 and 41. A heating element 46 is installed at an inner side of the wall member 41, and electrodes 47 and 48 are connected to both ends of the heating element 46. A base electrode 49 for forming an electric field is provided at an inner side of the wall member 40. An opposite electrode 51 is installed at a rear side of the recording paper 42. A power source 52 for applying a voltage is connected to the opposite electrode 51, and the base electrode 49 is grounded. Another power source 53 is also connected to the both ends of the heating element 46. A control unit 54 for turning on/off the power sources 52 and 53 according to an image signal is connected to the power sources 52 and 53.

When a voltage is applied from the power source 52 between the base electrode 49 and the opposite electrode 51, ink 43 near the exhaust hole 44 is affected by the electric field. If a current is simultaneously applied from the power source 53 to the heating element 46, only ink 43 around the heating element 46 is ejected to the recording paper 42.

In the aforementioned conventional ink-jet printhead for ejecting ink using an electrostatic force, a very high voltage should be applied between two electrodes or ink should be locally heated by an additional heating element so that ink droplets are separated from the surface of ink to be ejected. These requirements increase power consumption. Due to electric charges irregularly collected on the surface of ink, it is very difficult to precisely control the volume and speed of ejected ink droplets. Thus, it is difficult to implement high-resolution printing.

Accordingly, in order to implement a low power consumption ink-jet printhead having high printing speed and high resolution, a new ink droplet ejection mechanism is needed.

SUMMARY OF THE INVENTION

The present invention provides an ink ejecting method by which ink is previously separated from droplets having a predetermined volume in a nozzle and ink droplets are ejected through the nozzle.

The present invention also provides a low power consumption ink-jet printhead having high integration and high resolution utilizing the ink ejecting method.

According to a feature of an embodiment of the present invention, a method of ejecting ink includes (a) filling a rear end of a nozzle with ink using a capillary force, the rear end of the nozzle being surrounded by a hydrophilic layer, (b) forming an electric field directed toward an outlet of the nozzle on a front end of the nozzle, the front end of the nozzle being surrounded by a hydrophobic layer, (c) varying a surface tension of ink to separate ink droplets having a predetermined volume from ink and to move the separated ink droplets within the front end of the nozzle toward the outlet of the nozzle, and (d) ejecting the separated ink droplets through the outlet of the nozzle.

In the method, forming an electric field directed toward the outlet of the nozzle may include sequentially applying a voltage to a plurality of electrode pads, the plurality of electrode pads being disposed on the front end of the nozzle at predetermined intervals in a lengthwise direction of the nozzle. Varying the surface tension of ink may include lowering the surface tension of ink adjacent to one of the plurality of electrode pads to which the voltage is applied so that a contact angle of ink with respect to the hydrophobic layer is reduced.

In the method, forming the electric field and varying the surface tension of ink may include sequentially applying a voltage to a first electrode pad and a second electrode pad of the plurality of electrode pads to move ink within the front end of the nozzle to a position corresponding to a location of the second electrode pad, and cutting off the voltage applied to the first electrode pad to separate the ink droplets from ink.

The method may further include cutting off the voltage applied to the second electrode pad and sequentially applying a voltage to at least one electrode pad of the plurality of electrode pads disposed after the second electrode pad to move the separated ink droplets toward the outlet of the nozzle, after the separation of the ink droplets from ink.

In the method, an area of each of the plurality of electrode pads is variable so that a volume of the ink droplets is adjustable. A moving speed of the separated ink droplets in the front end of the nozzle is adjusted by a time difference during the sequential application of the voltage to the plurality of electrode pads.

The method may further include cutting off the voltage applied to an electrode pad where the ink droplets are located, prior to ejecting the separated ink droplets. In the method, the ejection of the separated ink droplets may be performed by an electrostatic force or by lowering an atmospheric pressure around the outlet of the nozzle.

According to another feature of an embodiment of the present invention, there is provided an ink-jet printhead including a capillary nozzle, having a rear end being surrounded by a hydrophilic layer, a front end being surrounded by a hydrophobic layer, and an outlet, an insulating layer, which is formed at an external surface of the hydrophobic layer along a lengthwise direction of the nozzle, a plurality of electrode pads disposed at an external surface of the insulating layer at predetermined intervals along the lengthwise direction of the nozzle, an opposite electrode disposed at an external surface of the hydrophobic layer and opposite to the plurality of electrode pads, a voltage applying unit, which sequentially applies a voltage to the plurality of electrode pads and forms an electric field directed toward the outlet of the nozzle to separate ink droplets having a predetermined volume from ink and move the separated ink droplets toward the outlet of the nozzle, and a droplets ejecting unit, which ejects the separated ink droplets through the outlet of the nozzle.

In an embodiment of the present invention, the hydrophobic layer may be a porous layer, and the opposite electrode and the separated ink droplets may be electrically connected via porosities of the porous layer.

In another embodiment of the present invention, the ink-jet printhead may further include a plurality of through holes formed in the hydrophobic layer at a location corresponding to the opposite electrode, wherein the opposite electrode and the separated ink droplets are electrically connected via the plurality of through holes.

In yet another embodiment of the present invention, the ink-jet printhead may further include a plurality of probes provided on the opposite electrode, the plurality of probes perforating the hydrophobic layer, wherein the opposite electrode and the separated ink droplets are electrically connected via the plurality of probes.

In the above embodiments, the nozzle may have a rectangular cross-sectional shape or a circular cross-sectional shape. Further, the plurality of electrode pads may be three electrode pads disposed in a line.

The voltage applying unit may include a first power source connected to each of the plurality of electrode pads, and a control unit, which is provided between the first power source and the plurality of electrode pads, the control unit controlling the first power source so that a voltage is sequentially applied from the first power source to the plurality of electrode pads. Alternately, the voltage applying unit may include a plurality of power sources, each of the plurality of power sources being connected to a corresponding one of the plurality of electrode pads.

The droplets ejecting unit may include an external electrode installed to face the outlet of the nozzle, and a second power source for applying a voltage to the external electrode to form an electric field between the nozzle and the external electrode, wherein the separated ink droplets are ejected through the outlet of the nozzle due to an electrostatic force acting on the separated ink droplets.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1A:
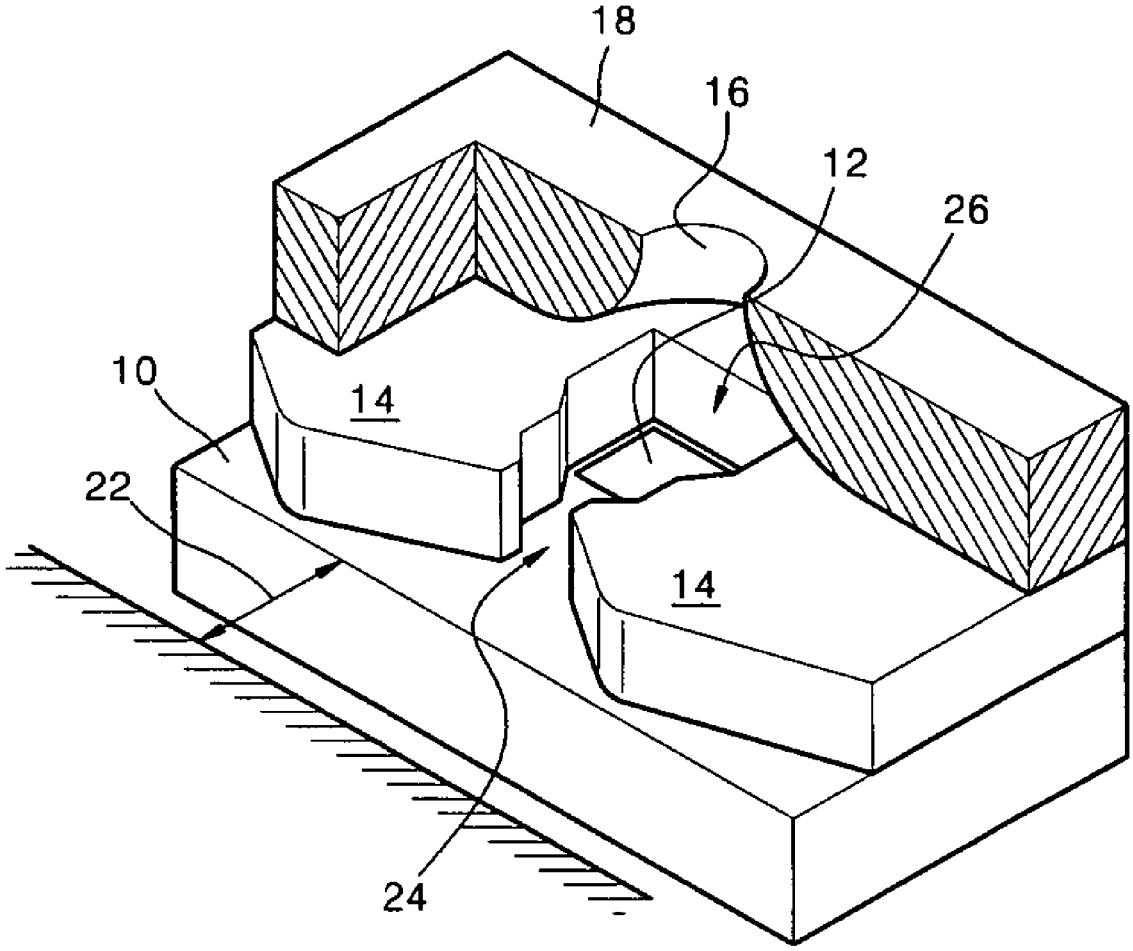
FIG. 1A (PRIOR ART)
FIG. 1A illustrates a cutaway perspective view of a structure of a conventional ink-jet printhead.
Figure 1B:
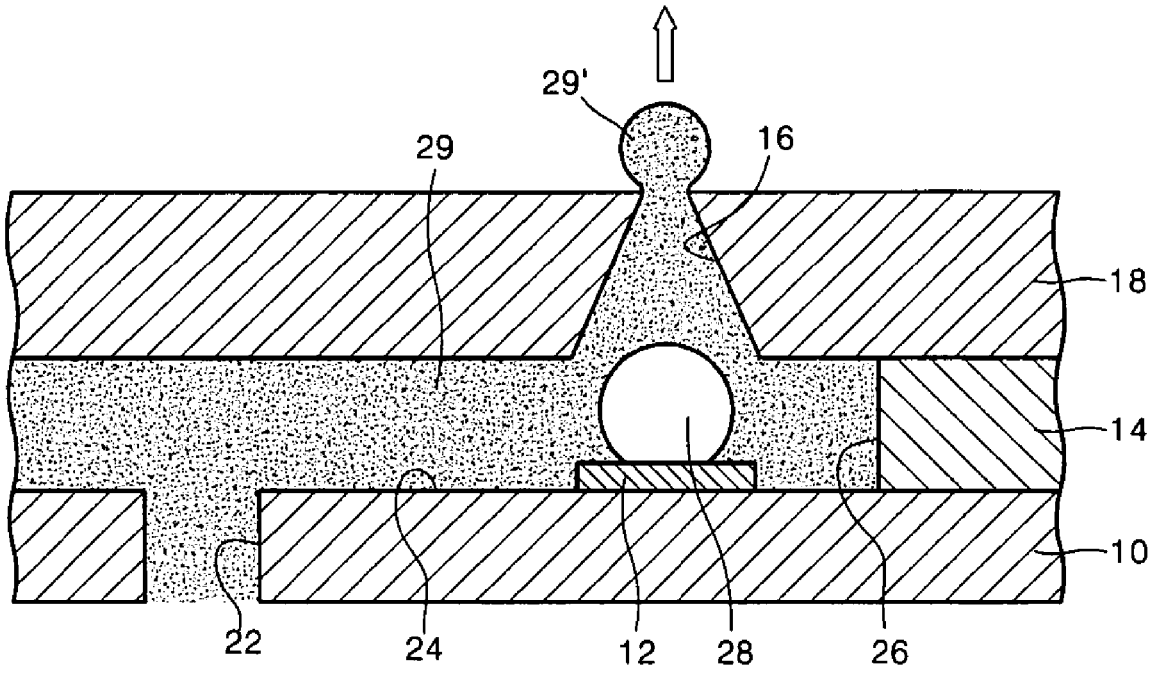
FIG. 1B (PRIOR ART)
FIG. 1B illustrates a cross-sectional view for explaining an ink droplet ejection mechanism of the conventional ink-jet printhead shown in FIG. 1A.
Figure 2A:
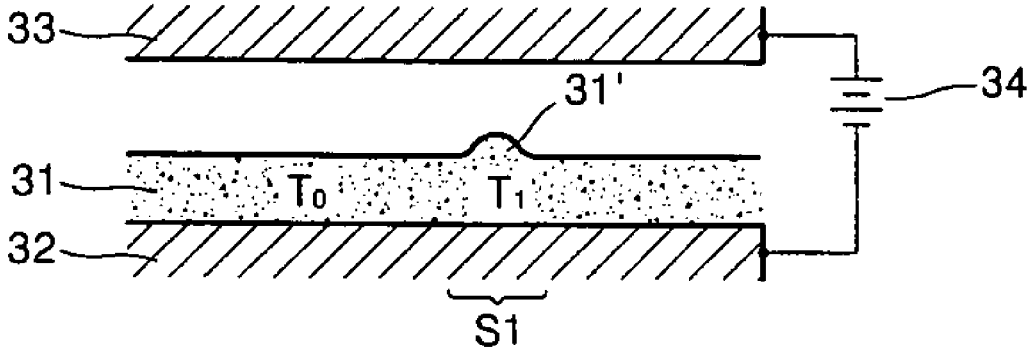
FIG. 2A (PRIOR ART)
FIGS. 2A and 2B illustrate another example of a conventional ink droplet ejection mechanism and schematically show a principle of ink droplet ejection using an electrostatic force.
Figure 2B:
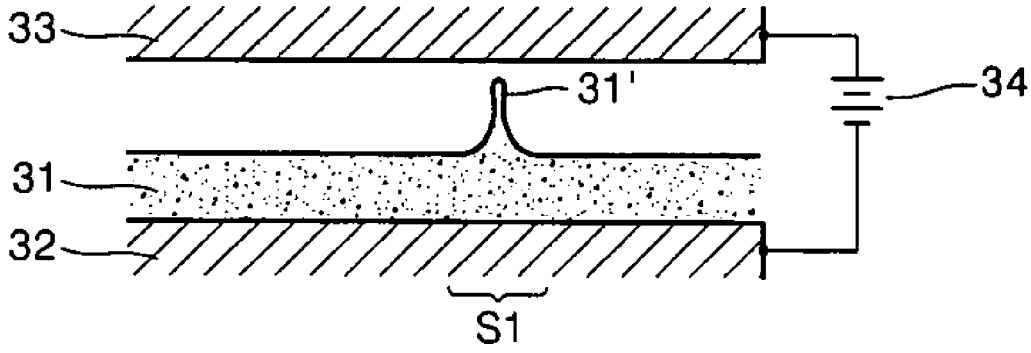
FIG. 2B (PRIOR ART)
Figure 3:
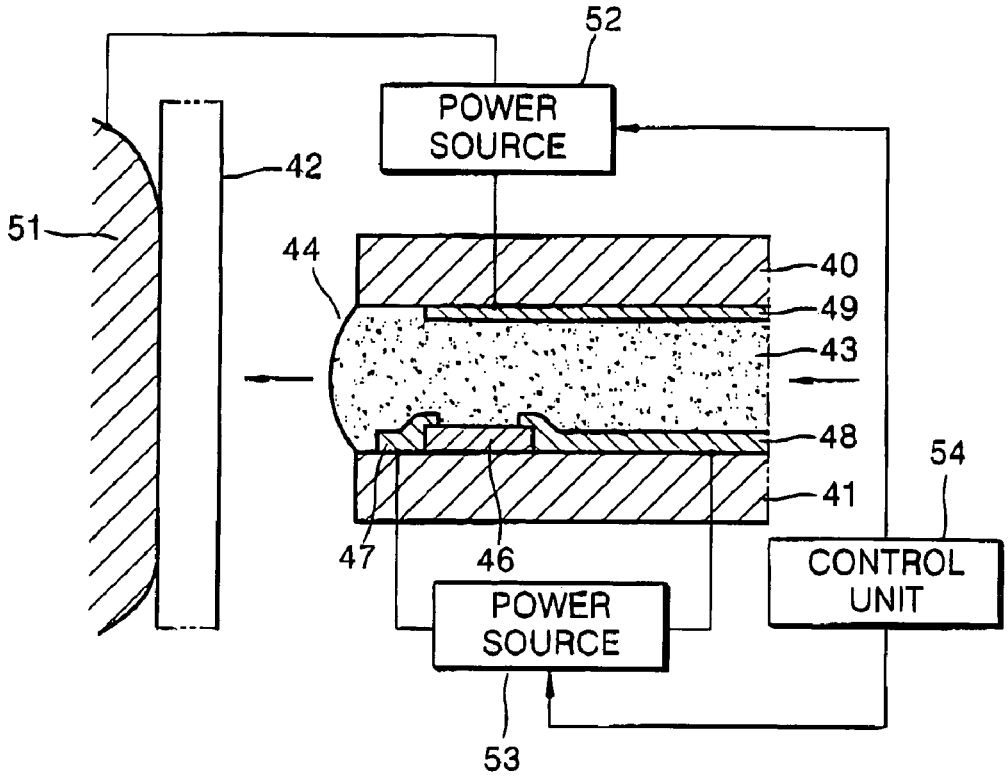
FIG. 3 (PRIOR ART)
FIG. 3 illustrates a schematic cross-sectional view of a conventional ink-jet printhead utilizing the ink ejecting method shown in FIGS. 2A and 2B.

Korean Patent Application No. 2003-2729, filed on Jan. 15, 2003, and entitled: "Ink Ejecting Method and Ink-Jet Printhead Utilizing the Method," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like reference numerals refer to like elements throughout.

Figure 4:
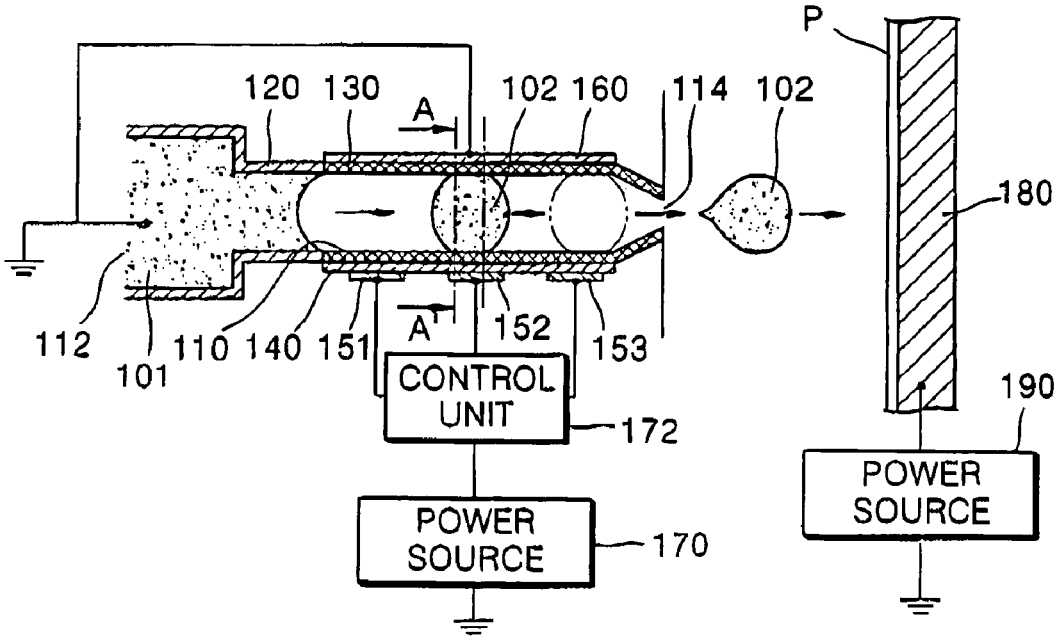
FIG. 4 illustrates a schematic cross-sectional view in a lengthwise direction of a nozzle of a structure of an ink-jet printhead according to a first embodiment of the present invention.
Figure 5:
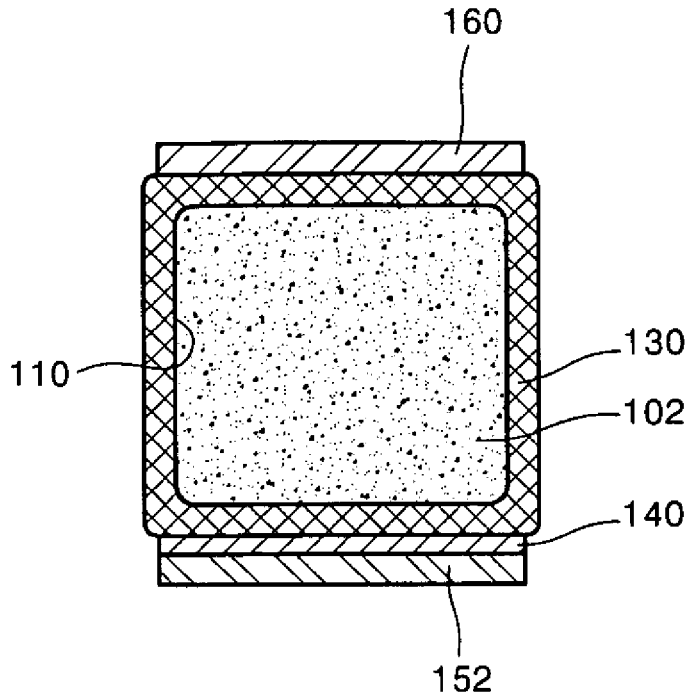
FIG. 5 illustrates a cross-sectional view of the nozzle taken along line A-A' of FIG. 4.

FIG. 4 illustrates a schematic cross-sectional view in a lengthwise direction of a nozzle of a structure of an ink-jet printhead according to a first embodiment of the present invention. FIG. 5 illustrates a cross-sectional view of the nozzle taken along line A-A' of FIG. 4. Although only a unit structure of an ink-jet printhead is shown, a plurality of nozzles are disposed in one row or in two or more rows in an ink-jet printhead manufactured in a chip shape.

Referring to FIGS. 4 and 5, the ink-jet printhead according to the first embodiment of the present invention includes a nozzle 110 through which ink 101 supplied from an ink reservoir (not shown) is ejected. A hydrophilic layer 120 surrounds a rear end of the nozzle 110. A hydrophobic layer 130 surrounds a front end of the nozzle 110. More specifically, the hydrophilic layer 120 forms a wall member of the nozzle 110 in a predetermined distance along a lengthwise direction of the nozzle 110 from a nozzle inlet 112, and the hydrophobic layer 130 forms a wall member of the nozzle 110 from the hydrophilic layer 120 to an outlet 114 of the nozzle 110. Thus, ink 101 supplied from the ink reservoir may be filled by a capillary force only in a rear end of the nozzle 110, which is surrounded by the hydrophilic layer 120. Additionally, ink 101 has conductivity. For example, a nonpolarity solvent is mixed with a pigment having a predetermined polarity to form ink 101.

An insulating layer 140 is formed at an external surface of the hydrophobic layer 130 along the lengthwise direction of the nozzle 110. As shown in FIG. 5, when the nozzle 110 has a rectangular cross-sectional shape, the insulating layer 140 may be formed at one side, for example, on a bottom surface of the hydrophobic layer 130.

At least two, and preferably three, electrode pads 151, 152, and 153 are disposed at a lower external surface of the insulating layer 140 in a line at predetermined intervals along the lengthwise direction of the nozzle 110. Meanwhile, three or more electrode pads may be disposed at the external surface of the insulating layer 140. An opposite electrode 160 is disposed at an external surface, that is, on an upper surface of the hydrophobic layer 130 opposite to the three electrode pads 151, 152, and 153.

A voltage applying unit for sequentially applying a voltage to the three electrode pads 151, 152, and 153 is provided. A first power source 170 connected to each of the three electrode pads 151, 152, and 153 may be used as the voltage applying unit. In this case, a control unit 172 is provided between the first power source 170 and the three electrode pads 151, 152, and 153. The control unit 172 controls the first power source 170 so that a voltage is sequentially applied from the first power source 170 to the three electrode pads 151, 152, and 153. For example, a switching unit may be used as the control unit 172.

Additionally, a power source may be provided in each of the three electrode pads 151, 152, and 153.

The opposite electrode 160 is grounded, and ink 101 filled in the rear end of the nozzle 110 is grounded. In addition, the hydrophobic layer 130 may be a porous layer having a plurality of porosities. Thus, as will be described later, ink droplets 102 separated from ink 101 may contact the opposite electrode 160 via the porosities. Accordingly, the separated ink droplets 102 are electrically connected to the opposite electrode 160.

In the ink-jet printhead having the above structure, when a voltage is sequentially applied to the three electrode pads 151, 152, and 153, an electric field is formed in the nozzle 110, and the electric field moves toward the outlet 114 of the nozzle 110. As such, the electric field acts on ink 101 inside the nozzle 110, and the ink droplets 102 are separated from ink 101. The separated ink droplets 102 move toward the outlet 114 of the nozzle 110. This process will be subsequently described in greater detail with reference to FIGS. 10A through 10E.

A droplets ejecting unit for ejecting the ink droplets 102 through the outlet 114 of the nozzle 110 is provided. The droplets ejecting unit may include an external electrode 180 installed to be opposite to the outlet 114 of the nozzle 110 and a second power source 190 for applying a voltage to the external electrode 180. Thus, the ink droplets 102 may be ejected from the nozzle 110 to a recording paper P provided at a front side of the external electrode 180. The operation of the droplets ejecting unit will be subsequently described in more detail.

Figure 6:
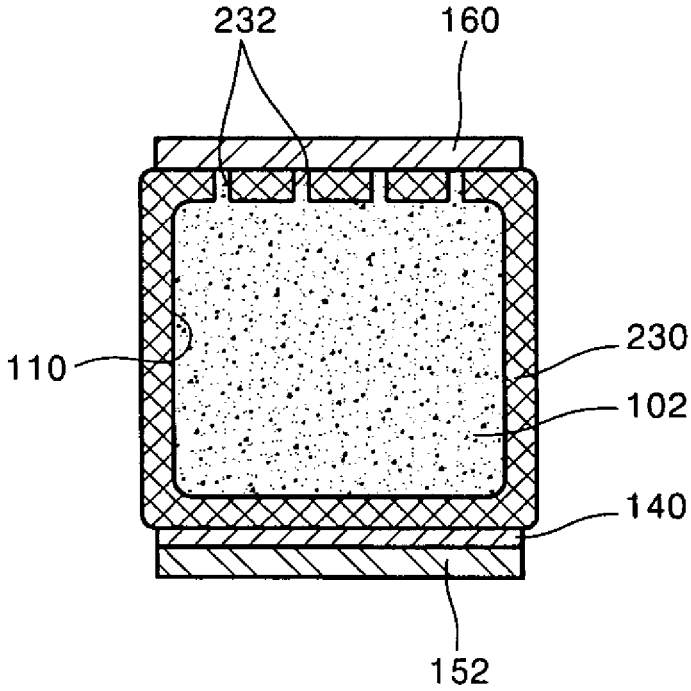
FIGS. 6 through 8 illustrate a cross-sectional structure of the nozzle according to a second, third and fourth embodiment of the present invention, respectively.
Figure 7:
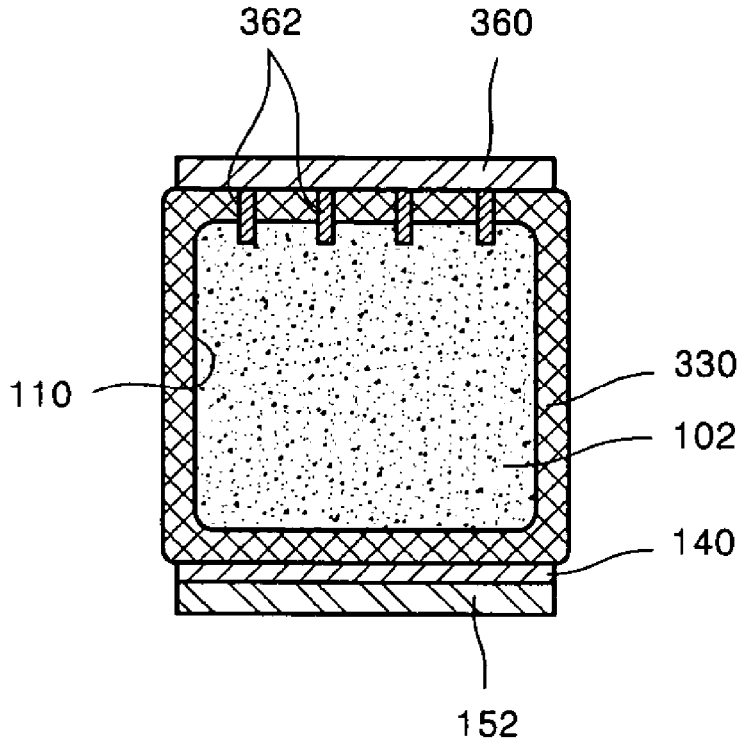
Figure 8:
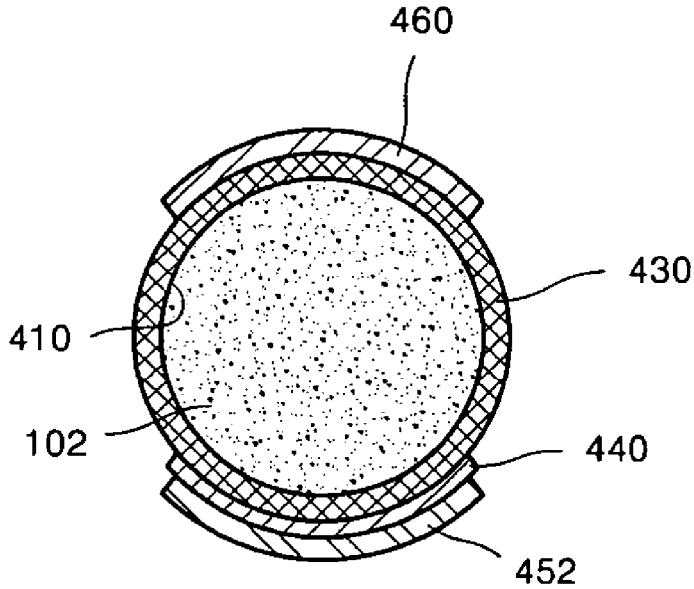

FIGS. 6 through 8 illustrate a cross-sectional structure of the nozzle according to second through fourth embodiments of the present invention. Like reference numerals from FIG. 5 denote elements having same functions.

Referring to FIG. 6, a hydrophobic layer 230 surrounding the nozzle 110 may not be a porous layer, unlike in the first embodiment. In the second embodiment, a plurality of through holes 232 is formed in a portion where the opposite electrode 160 is disposed so that the opposite electrode 160 and the ink droplets 102 are electrically connected in the nozzle 110. Thus, the ink droplets 102 contact the opposite electrode 160 via the plurality of through holes 232 so that the ink droplets 102 and the opposite electrode 160 are electrically connected.

Referring to FIG. 7, if a hydrophobic layer 330 is not a porous layer as in the second embodiment, a plurality of probes 362 perforating the hydrophobic layer 330 may be installed on the opposite electrode 360. Thus, in the third embodiment, the opposite electrode 360 and the ink droplets 102 are electrically connected via the plurality of probes 362.

Referring to FIG. 8, a nozzle 410 may have a circular cross-sectional shape, unlike in the previous embodiments. Alternately, the nozzle 410 may have a variety of cross-sectional shapes, such as an oval cross-sectional shape or a polygonal cross-sectional shape, in addition to the rectangular cross-sectional shape and the circular cross-sectional shape.

As shown in FIG. 8, in the fourth embodiment, when the nozzle 410 has the circular cross-sectional shape, a hydrophobic layer 430 surrounding the nozzle 410 has a circular shape. An insulating layer 440 is provided to a predetermined width at a lower external surface of the hydrophobic layer 430, and an electrode pad 452 is disposed at an external surface of the insulating layer 440, and an opposite electrode 460 is disposed at an upper external surface of the hydrophobic layer 430.

Hereinafter, the operation of the ink-jet printhead having the above structure according to the first embodiment of the present invention will be described.

Figure 9:
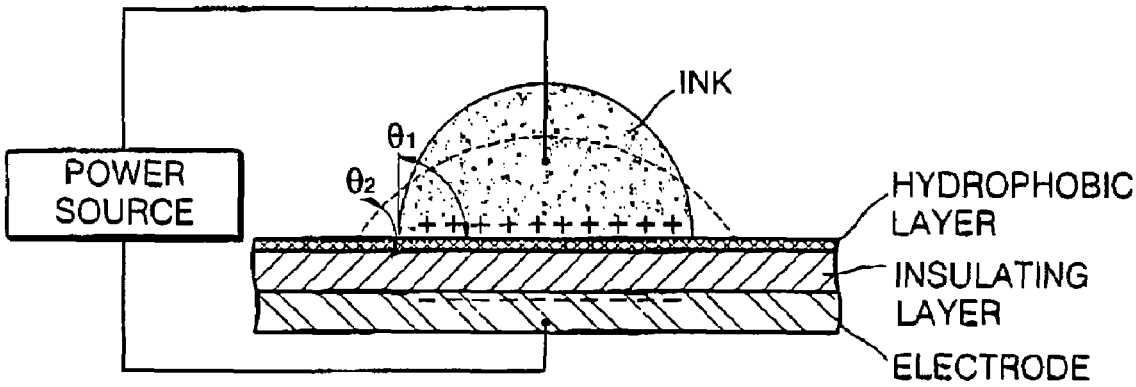
FIG. 9 schematically illustrates the movement of ink in the nozzle of FIG. 4.

FIG. 9 schematically explains the movement of ink in the nozzle of FIG. 4. Referring to FIG. 9, if a voltage is not applied to an electrode, due to the surface tension of ink, ink contacts the surface of a hydrophobic layer at a relatively large contact angle $\Theta_1$. Alternately, if the voltage is applied from a power source to the electrode, an electric field acts on ink having conductivity. As such, electric charges having predetermined polarity, e.g., negative electric charges, are collected at an interface between the electrode and an insulating layer, and electric charges having opposite polarity, e.g., positive electric charges, are collected at an interface between ink and the hydrophobic layer. Since a repulsive force acts between the positive electric charges collected at the interface between ink and the hydrophobic layer, the surface tension of ink is reduced. Thus, as indicated by a dotted line, a contact angle $\Theta_2$ of ink with respect to the hydrophobic layer is reduced so that a contact area between ink and the hydrophobic layer is increased. In this way, ink reacts as if the property of the hydrophobic layer has been changed to a hydrophilic property. If the voltage applied to the electrode is cut off, due to the surface property of the hydrophobic layer, the surface tension of ink increases, and ink is returned to an original state indicated by a solid line.

Due to the movement of ink in the nozzle, ink droplets are separated from ink, and the separated ink droplets move toward the outlet of the nozzle. This process will now be described in detail with reference to FIGS. 10A through 10E.

FIGS. 10A through 10E sequentially illustrate an ink ejecting method according to an embodiment of the present invention.

Figure 10A:
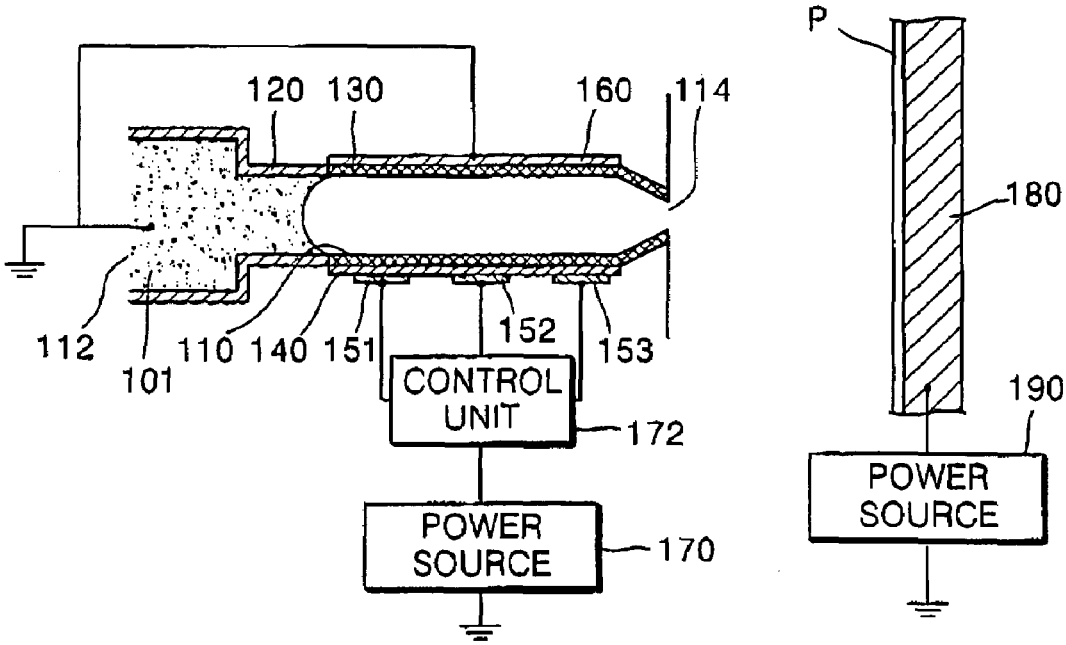
FIGS. 10A through 10E sequentially illustrate an ink ejecting method according to the first embodiment of the present invention.

Referring to FIG. 10A, ink 101 supplied from an ink reservoir (not shown) is filled by a capillary force in a rear end of the nozzle 110 surrounded by a hydrophilic layer 120. Ink, however, is not filled in a front end of the nozzle 110 surrounded by a hydrophobic layer 130 due to a surface property of the hydrophobic layer 130.

Figure 10B:
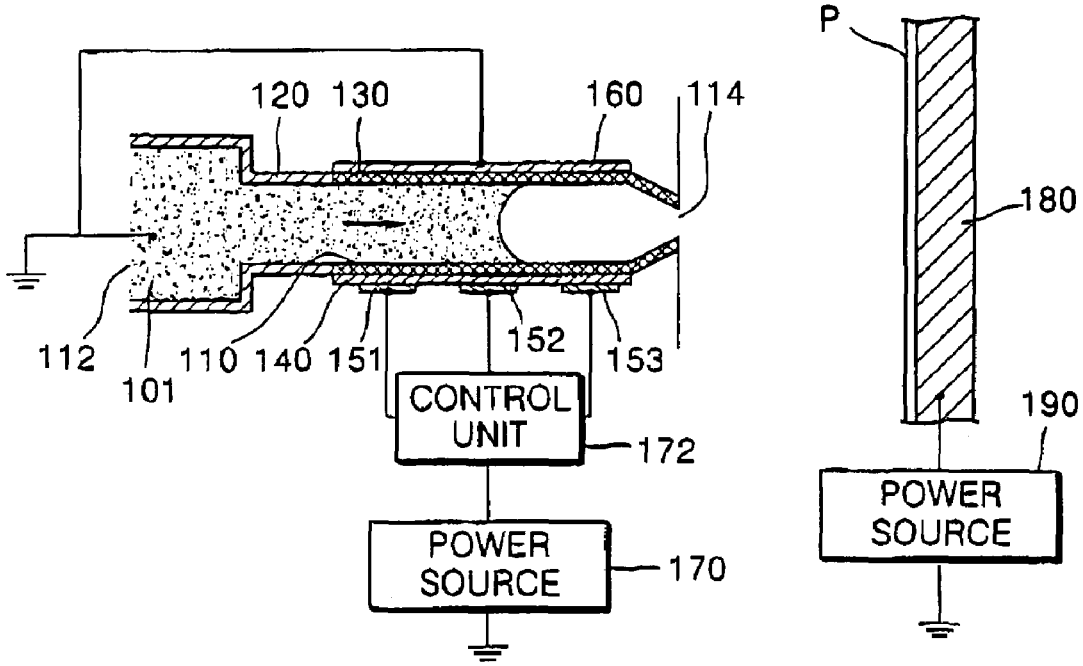
Figure 10C:
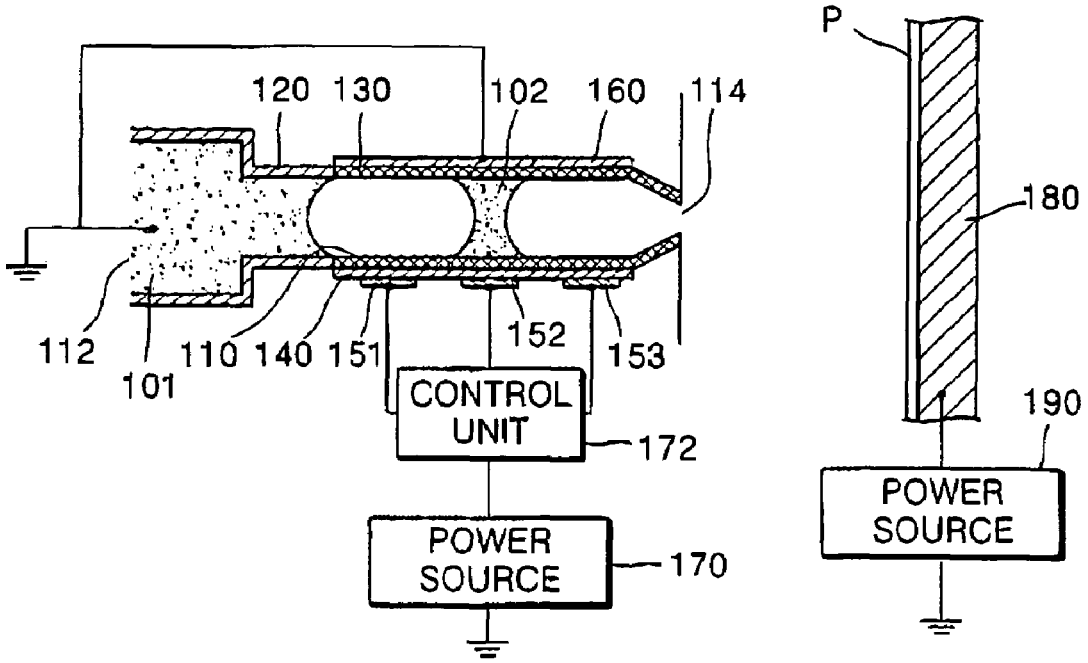

Next, as shown in FIG. 10B, when a voltage is sequentially applied from a first power source 170 to a first electrode pad 151 and a second electrode pad 152, ink 101 moves a portion of the nozzle 110 corresponding to a location of the second electrode pad 152. The movement of ink 101 occurs when a voltage is applied to the first and second electrode pads 151 and 152. This application of voltage causes the surface property of the hydrophobic layer 130 at a location corresponding to the first and second electrode pads 151 and 152 to change to a hydrophilic property. More specifically, when the voltage is applied to the first and second electrode pads 151 and 152, the surface tension of ink 101 is reduced by an electric field acting on ink 101. As such, a contact angle of ink 101 with respect to the hydrophobic layer 130 is reduced. Thus, ink 101 moves by a capillary force to the portion of the nozzle 110 corresponding to the position of the second electrode pad 152.

Next, as shown in FIG. 1C, when the voltage applied to the first electrode pad 151 is cut off, ink droplets 102 having a predetermined volume are separated from ink 101. More specifically, when the voltage is applied to the second electrode pad 152 and only the voltage applied to the first electrode pad 151 is cut off, the portion of the hydrophobic layer 130 corresponding to the location of the first electrode pad 151 is returned to a hydrophobic property, which is an original surface property. As such, ink 101 is separated into two parts at the location of the first electrode pad 151, and a portion of the ink 101 adjacent to the second electrode pad 152 forms a separated ink droplet 102 having a predetermined volume.

According to the present invention, the ink droplets 102 having a predetermined volume are separated from ink 101 in the nozzle 110 such that the volume of the ink droplets 102 ejected through the nozzle 110 becomes uniform. In the present invention, the area of each of the first and second electrode pads 151 and 152 may be varied, such that the volume of the ink droplets 102 may be adjustable, thereby resulting in finer and more uniform separate ink droplets 102.

When the length of the nozzle 110 is relatively short, only two electrode pads 151 and 152 are provided and the second electrode pad 152 is adjacent to the outlet 114 of the nozzle 110. Thus, the ink droplets 102 are separated from ink 101 and are ejected through the nozzle 110 using a predetermined droplets ejecting unit, as shown in FIG. 10E. In this case, when the voltage applied to the second electrode pad 152 is cut off, the hydrophobic layer 130 at a position corresponding to the location of the second electrode pad 152 is returned to a hydrophobic property. Thus, a contact angle of the ink droplets 102 with respect to the hydrophobic layer 130 is increased, and the ink droplets 102 are varied in a shape shown in FIG. 4. Thus, due to a lower driving force, for example, an electrostatic force, ejecting of ink droplets 102 is performed.

Figure 10D:
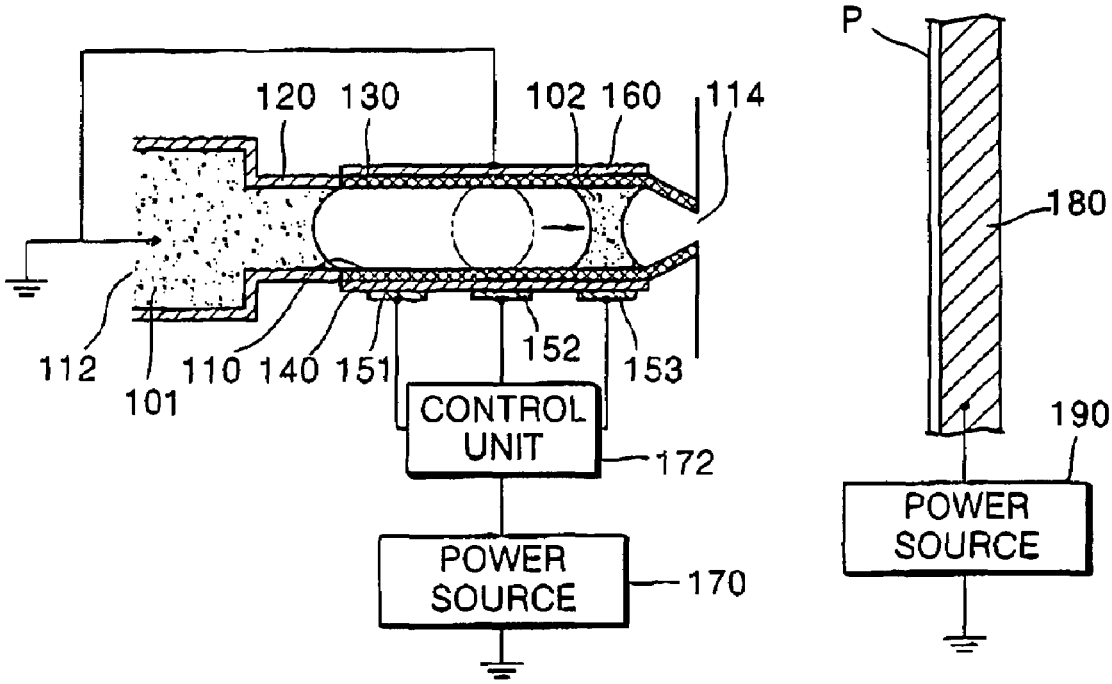
Figure 10E:
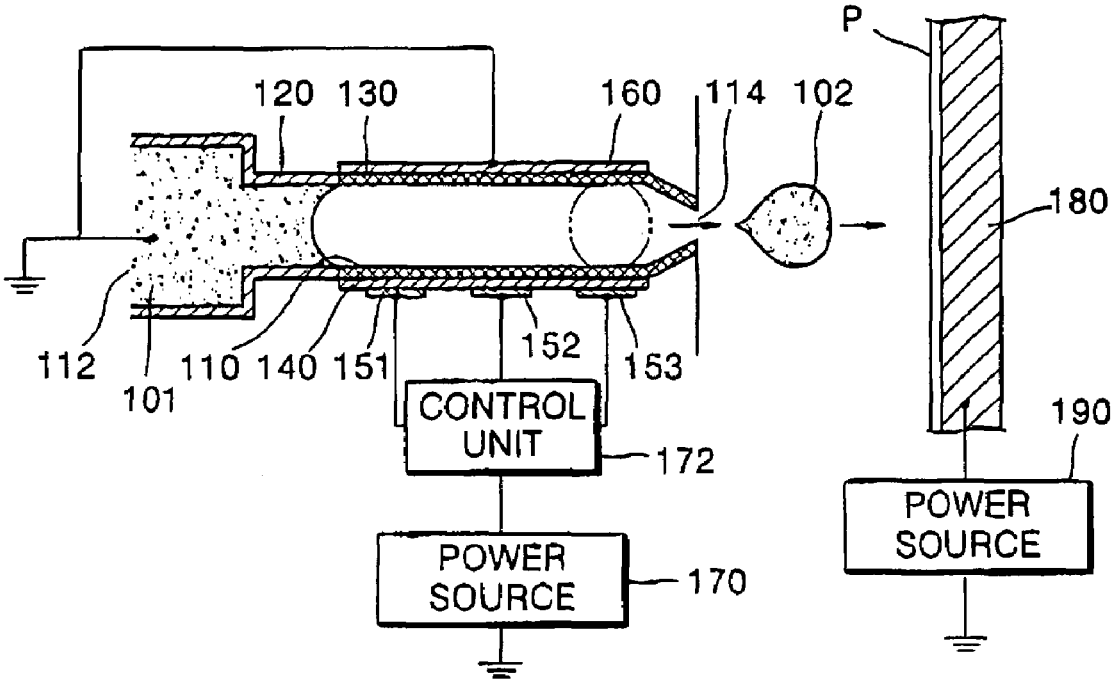

Meanwhile, when the length of the nozzle 110 is relatively long, as shown in FIG. 10D, the third electrode pad 153 is provided after the second electrode pad 152, and the step of moving the ink droplets 102 to a portion of the nozzle 110 corresponding to a location of the third electrode pad 153 may be performed.

Specifically, after the ink droplets 102 are separated from ink 101, when the voltage applied to the second electrode pad 152 is cut off and a voltage is applied to the third electrode pad 153, the ink droplets 102 move from a portion corresponding to the location of the second electrode pad 152, which has returned to a hydrophobic property, to a portion corresponding to a location of the third electrode pad 153, which has changed into a hydrophilic property. In this case, the portion of the nozzle 110 corresponding to the location of the first electrode pad 151 maintains a hydrophobic property. Thus, reverse movement of the ink droplets 102, i.e., backflow, is prevented.

When the length of the nozzle 110 is even longer, one or more electrode pad may be provided after the third electrode pad 153. If a voltage is sequentially applied to the electrode pads 151, 152, and 153, the ink droplets 102 consecutively move toward the outlet 114 of the nozzle 110, as described above.

In the case of a plurality of electrode pads, e.g., more than three, the moving speed of the ink droplets 102 in the nozzle 110 may be adjusted by a time difference when sequentially applying the voltage to the plurality of electrode pads.

The ink droplets 102 that have moved toward the outlet 114 of the nozzle 110 are ejected through the outlet 114 of the nozzle 110, as shown in FIG. 10E. Specifically, if a predetermined voltage is applied from the second power supply 190 to an external electrode 180, an electric field between the nozzle 110 and the external electrode 180 is formed. As such, an electrostatic force, that is, a Coulomb force, acts on the ink droplets 102. Accordingly, the ink droplets 102 may be ejected from the nozzle 110 to a recording paper P provided at a front side of the external electrode 180. If a voltage applied to the third electrode pad 153 is cut off before the ink droplets 102 are ejected, the hydrophobic layer 130 at the location corresponding to the third electrode pad 153 is returned to having a hydrophobic property. Thus, the ink droplets 102 may be easily ejected by a lesser electrostatic force.

Meanwhile, a variety of conventional methods, as well as the above-described method using an electrostatic force, may be used to actually eject the ink droplets 102 from the nozzle 110. For example, a fluid-flow may be formed around the outlet 114 of the nozzle 110, and the atmospheric pressure around the outlet 114 of the nozzle 110 may be lowered to eject the separated ink droplets 102.

As described above, in an ink ejecting method and an ink-jet printhead utilizing the method according to the present invention, since a lower voltage may be used, ink droplets having a predetermined volume are previously separated from ink in a nozzle and are ejected, necessary power consumption to eject the ink droplets may be reduced, and the volume of the ejected ink droplets may become uniform. In addition, the area of the electrode pad may be varied so that a volume of the ink droplets may be finely and precisely adjusted. Accordingly, a low power consumption ink-jet printhead having high resolution can be implemented.

Further, the moving speed of the ink droplets may be adjusted by a time difference when sequentially applying the voltage to a plurality of electrode pads. Additionally, ink in the nozzle may be prevented from flowing backward, and an ink refill operation is not required. Thus, an ink-jet printhead capable of printing at a high speed can be implemented.

Preferred and exemplary embodiments of the present invention have been disclosed herein and, although specific terms are employed, they are used and are to be interpreted in a generic and descriptive sense only and not for purpose of limitation. For example, although ink droplets separated from ink are shown and described in the exemplary embodiments of the present invention being ejected by an electrostatic force, the ink droplets may be ejected through the nozzle using different methods. More specifically, the present invention may be characterized in that ink droplets having a predetermined volume are separated from ink in the nozzle and the separated ink droplets are moved toward an outlet of the nozzle. Accordingly, it will be understood by those of ordinary skill in the art that various changes in form and details may be made without departing from the spirit and scope of the present invention as set forth in the following claims.

What is claimed is:

1. A method of ejecting ink comprising:

(a) filling a rear end of a nozzle with ink using a capillary force, the rear end of the nozzle being surrounded by a hydrophilic layer;

(b) forming an electric field directed toward an outlet of the nozzle on a front end of the nozzle, the front end of the nozzle being surrounded by a hydrophobic layer;

(c) modifying a magnitude and location of the electric field to modify a surface property of the hydrophobic layer to hydrophilic and vary a surface tension of the ink to separate at least one ink droplet having a predetermined volume from the ink within the front end of the nozzle and to move the at least one separated ink droplet within the front end of the nozzle toward the outlet of the nozzle; and (d) ejecting the separated ink droplets through the outlet of the nozzle.

2. The method as claimed in claim 1, wherein forming an electric field directed toward the outlet of the nozzle comprises:

sequentially applying a voltage to a plurality of electrode pads, the plurality of electrode pads being connected in series and disposed on the front end of the nozzle at predetermined intervals in a lengthwise direction of the nozzle.

3. The method as claimed in claim 2, wherein varying the surface tension of ink comprises:

lowering the surface tension of ink adjacent to one of the plurality of electrode pads to which the voltage is applied so that a contact angle of ink with respect to the hydrophobic layer is reduced.

4. The method as claimed in claim 3, wherein varying the surface tension of ink further comprises disposing an insulating layer in the front end of the nozzle in a lengthwise direction between the electrode pads and the hydrophobic layer.

5. The method as claimed in claim 2, wherein forming the electric field and varying the surface tension of ink comprises:

sequentially applying a voltage to a first electrode pad and a second electrode pad of the plurality of electrode pads to move ink within the front end of the nozzle to a position corresponding to a location of the second electrode pad; and cutting off the voltage applied to the first electrode pad to separate the ink droplets from ink.

6. The method as claimed in claim 5, wherein after the separation of the ink droplets from ink, (c) further comprises:

cutting off the voltage applied to the second electrode pad and sequentially applying a voltage to at least one electrode pad of the plurality of electrode pads disposed after the second electrode pad to move the separated ink droplets toward the outlet of the nozzle.

7. The method as claimed in claim 2, wherein an area of each of the plurality of electrode pads is variable so that a volume of the ink droplets is adjustable.

8. The method as claimed in claim 2, wherein a moving speed of the separated ink droplets in the front end of the nozzle is adjusted by a time difference during the sequential application of the voltage to the plurality of electrode pads.

9. The method as claimed in claim 2, wherein (d) further comprises:

cutting off the voltage applied to an electrode pad where the ink droplets are located, prior to ejecting the separated ink droplets.

10. The method as claimed in claim 2, wherein footing the electric field further comprises disposing a non-continuous hydrophobic layer in the front end of the nozzle opposite the electrode pads.

11. The method as claimed in claim 10, wherein disposing the non-continuous hydrophobic layer comprises applying a hydrophobic layer having a plurality of pores, holes or probes to the lengthwise direction along an external front end of the nozzle, such that the ink and an electrode disposed opposite the electrode pads, are electrically connected.

12. The method as claimed in claim 1, wherein in (d), the ejection of the separated ink droplets is performed by an electrostatic force.

13. The method as claimed in claim 1, wherein in (d), the ejection of the separated ink droplets is performed by lowering a pressure of a fluid flow around the outlet of the nozzle.

14. The method as claimed in claim 1, wherein the separated ink droplet within the front end of the nozzle is spaced apart from the ink within the front end of the nozzle before being moved toward the outlet of the nozzle to be ejected.

15. A method of ejecting ink, comprising:

filling a rear end of a nozzle with ink using a capillary force, the rear end of the nozzle being surrounded by a hydrophilic layer;

forming an electric field directed toward an outlet of the nozzle on a front end of the nozzle surrounded by a hydrophobic layer, the electric field moving at least a portion of the ink within the front end of the nozzle;

changing a surface property of at least one predetermined portion of the hydrophobic layer to hydrophilic and varying a surface tension of the ink to separate at least one ink droplet having a predetermined volume from the ink within the front end of the nozzle and moving the separated ink droplet within the nozzle toward the outlet of the nozzle; and ejecting the separated ink droplet through the outlet of the nozzle.

16. The method as claimed in claim 15, wherein forming the electric filed comprises sequentially applying a voltage to a plurality of electrode pads, the plurality of electrode pads being connected in series and disposed on the front end of the nozzle at predetermined intervals in a lengthwise direction of the nozzle.

17. The method as claimed in claim 16, wherein each of the electrode pads corresponds to a respective predetermined portion of the hydrophobic layer and each of the respective predetermined portions of the hydrophobic layer retains hydrophobic properties so long as a voltage is not applied to the respective electrode pad.

18. The method as claimed in claim 17, wherein changing a property of at least one of the predetermined portions comprises applying a voltage to the respective one of the electrode pads corresponding to the at least one predetermined portion.

19. A method of ejecting ink, comprising:

filling a rear end of a nozzle with ink using a capillary force, the rear end of the nozzle being surrounded by a hydrophilic layer;

changing a surface property of a first portion of a layer surrounding a front end of the nozzle from hydrophobic to hydrophilic, the first portion including at least a first sub-portion and a second sub-portion;

changing the surface property of the first sub-portion of the first portion back to hydrophobic to separate an ink droplet having a predetermined volume from the ink, the predetermined volume corresponding to an area of the second sub-portion;

changing the surface property of a second sub-portion of the first portion back to hydrophobic to move the separated ink droplet to a second portion of the front end of the nozzle, the second portion being closer to an outlet of the nozzle than the first portion; and ejecting the separated ink droplet through the outlet of the nozzle.

20. The method as claimed in claim 19, wherein the second sub-portion is closer to the outlet than the first sub-portion.

* * * * *